US009257207B2

(12) United States Patent
Funk et al.

(10) Patent No.: US 9,257,207 B2
(45) Date of Patent: Feb. 9, 2016

(54) MULTI FOCAL SPOT COLLIMATOR

(75) Inventors: Tobias Funk, Martinez, CA (US); Brian Wilfley, Los Altos, CA (US); Peter Holst, Los Altos, CA (US)

(73) Assignee: Triple Ring Technologies, Inc., Newark, CA (US)

( * ) Notice: Subject to any disclaimer, the term of this patent is extended or adjusted under 35 U.S.C. 154(b) by 453 days.

(21) Appl. No.: 13/291,804

(22) Filed: Nov. 8, 2011

(65) Prior Publication Data

US 2013/0114796 A1 May 9, 2013

(51) Int. Cl.
*G21K 1/02* (2006.01)

(52) U.S. Cl.
CPC ..... *G21K 1/025* (2013.01)

(58) Field of Classification Search
CPC ..... G21K 1/025; G21K 1/02
USPC ..... 378/147–153
See application file for complete search history.

(56) References Cited

U.S. PATENT DOCUMENTS

| | | | | |
|---|---|---|---|---|
| 2007/0133749 | A1* | 6/2007 | Mazin et al. | 378/147 |
| 2008/0304619 | A1* | 12/2008 | Blevis et al. | 378/16 |
| 2009/0084933 | A1* | 4/2009 | Appleby et al. | 249/119 |
| 2009/0213984 | A1* | 8/2009 | Warner et al. | 378/16 |
| 2010/0202591 | A1* | 8/2010 | McKim et al. | 378/149 |

* cited by examiner

*Primary Examiner* — Hoon Song
(74) *Attorney, Agent, or Firm* — Sabrina N. David; Joseph T. Lin

(57) ABSTRACT

An x-ray collimator can be constructed from multiple subassemblies, which at least includes a first subassembly that reduces the leakage of x-ray radiation between adjacent apertures and a second subassembly that reduces the spill of x-ray radiation around the detector face. Each of these subassemblies has numerous apertures. In the first subassembly these apertures correspond to focal spots on an x-ray source, and in the second subassembly, these apertures are shaped such that the dimensions increase from smaller entrances to larger exits.

20 Claims, 7 Drawing Sheets

MULTI FOCAL SPOT COLLIMATOR

FIELD OF THE INVENTION

The present invention pertains to multi focal spot collimators. More particularly, the present invention pertains to multi focal spot collimators for x-rays.

BACKGROUND

X-ray imaging systems have become invaluable in the medical field for a variety of surgical and diagnostic purposes. The implementation of many cardiac, urological, orthopedic, peripheral vascular, and a variety of non-invasive surgical procedures rely on the ability of the surgeon or medical authority to clearly track an implement they have inserted into a patient, such as a catheter, or otherwise monitor a region of interest within the patient through fluoroscopy. An example of a known fluoroscopy system is U.S. Pat. No. 2,730,566 issued to Bartow, et. al. entitled "Method and Apparatus for X-Ray Fluoroscopy. Computer Tomography (CT), in which a moving source-detector pair takes numerous two-dimensional images while rotating around a patient for reconstruction, is one of the preeminent methods of generating three-dimensional internal images used for cancer, other disease, and injury diagnoses. Single tomographic x-ray images are valuable for analysis as well.

The process of generating an x-ray image of a region of interest entails the positioning of a patient between an x-ray source and an x-ray detector, emission of x-rays from the x-ray source, the travel of these x-rays through a targeted volume of the patient, and the absorption of these x-rays by the x-ray detector. Since areas of a patient which are x-ray dense—notably, bones or vessels and tissues which have been highlighted by insertion of a contrast element—will absorb or scatter incident x-rays, the amount of x-ray photons reaching a given point on the x-ray detector corresponds to the x-ray density of the patient along a line between the x-ray source and that point on the detector. Therefore, intensity information from the detector can be used to reconstruct an image of the area of the patient through which the x-rays travelled.

Increasing the x-ray flux can improve image quality by increasing the amount of x-rays photons that pass through the patient and reach the detector, hence increasing the amount of intensity data available for image reconstruction. However, in addition to image quality considerations, decisions surrounding the x-ray flux are concerned with avoiding unnecessary exposure of the patient and attending medical personnel to x-ray radiation. While exposure of tissue to an extremely high amount of radiation at a given time would be necessary to see immediate negative health reactions such as radiation burns, a few relatively heavy doses to a patient or perpetual smaller doses to medical personnel may significantly increase probability of cancer later in life.

To maintain an x-ray flux sufficient for the generation of high-quality images while reducing x-ray exposure to system surroundings, an x-ray dense unit with a single aperture is generally positioned against the face of the x-ray source so that x-rays travelling along paths which, if uninterrupted, would not strike the detector face will be absorbed within its volume. The process of selectively attenuating x-rays is referred to as collimation, and the attenuating unit as a collimator.

Detector photon counts from absorption of scattered x-rays, which lower the image quality by contributing incorrect intensity information, are referred to as scatter noise. Systems have been developed with an "inverse geometry" such that the face of the x-ray source is relatively large and the face of the detector relatively small compared to conventional systems. Inverse geometry systems suffer significantly less from scatter noise as a smaller detector face decreases the probability of scattered ray absorption.

A notable type of inverse geometry systems is the scanning x-ray beam system such as the one disclosed in U.S. Pat. No. 5,729,584 entitled "Scanning Beam X-Ray Imaging System." In scanning beam systems, x-ray beams are sequentially emitted from different points on the source, called focal spots, at very high speed rather than from the entire source face simultaneously. Since a number of images (corresponding to the number of emissive points on the source face) are used to reconstruct a single frame, the amount of patient volume exposed to x-rays at a given time, namely a narrow cone connecting a single aperture and the detector face, can be small compared to non-scanning systems where the entire target volume is continuously exposed. Scatter noise may be even lower in scanning beam systems as at a given time, scatter can only occur within this narrow illuminated cone rather than anywhere in the target volume. Information regarding the angular dependence of scanning beam images can also be used to add a three-dimensional, or tomographic, quality to the frames.

Non-conventional collimation devices are necessary for inverse geometry, scanning beam, and other multi focal spot x-ray imaging systems for a variety of reasons.

A multi focal spot collimator must direct x-rays from a source of large surface area to a small detector rather than from a small source to a large detector. This generally requires a plurality of closely-spaced apertures, each angled and shaped to emit x-rays that will intersect the detector face when illuminated by the source and attenuate x-rays that would spill around the detector face. Furthermore, in scanning beam systems, image reconstruction techniques rely on the assumption that x-rays are being emitted through only the intended aperture or intended apertures when a focal spot illuminates the collimator.

Additionally, while many single focal spot sources contain an x-ray reflective element so that the emissive portion of the source is positioned farther back in the body of the source, inverse geometry systems may require transmissive sources in which the target screen is the most outward element of the source. Material being constantly struck with high energy electrons and emitting Bremsstrahlung x-ray radiation will overheat without some sort of cooling system. Fast-moving, coolant fluid which absorbs and carries away excess heat is the key element in many cooling systems. Thus, in a system with a transmissive source, the collimator can be in contact with a coolant fluid system.

As a transmissive source may control the position of an electron beam with an applied magnetic field, any external electromagnetic fields may alter the beam path and disrupt the proper functioning of the x-ray source.

While the balance between x-ray image quality and dose control, improved by collimated multi focal spot systems, is particularly relevant in medical applications as discussed above, it can also be relevant in baggage screening, security applications, and other x-ray imaging applications.

SUMMARY

In one embodiment of the present invention, a multi focal spot x-ray collimator based on two subassemblies—a subassembly that reduces the amount of x-ray leakage between apertures and a subassembly that reduces the amount of x-ray radiation that doesn't strike the detector face after emission through the intended aperture(s)—is provided. These subassemblies both have apertures through which x-rays may pass. The subassembly that reduces x-ray leakage can be made up of a number of material sheets where each sheet has a thickness of at least 0.5 mm, can be made of a material with an atomic number of at least thirty-nine, can be made of a material with a value of Young's modulus of at least 200 GPa, can be made of tungsten, or can made to have thickness of at least 1 mm. The subassembly that reduces x-ray radiation spill around the detector face can be made of a number of material sheets where each sheet has a thickness of at least 0.5 mm, can be made of a material with an atomic number between eleven and thirty-eight, can be made of a material with relative magnetic permeability of at least 5,000, can be made of mu-metal, can be made of brass, can be made of steel, or can be made to have a thickness of at least 5 mm.

In another embodiment, a further subassembly is positioned in the collimator so that it is the subassembly nearest the x-ray source. This subassembly has numerous apertures, has a thickness of at least 0.5 mm, and is made from a material having an atomic number of at least 39.

In another embodiment, a further subassembly is positioned in the collimator so that it is the subassembly farthest from the x-ray source. This subassembly has numerous apertures, has a thickness of at least 1 mm, is made from a material having an atomic number of at least 39. This subassembly can be positioned so that it is separated by an air gap from an adjacent subassembly or can have apertures shaped such that an aperture entrance is smaller than an aperture exit.

These and other objects and advantages of the various embodiments of the present invention will be recognized by those of ordinary skill in the art after reading the following detailed description of the embodiments that are illustrated in the various drawing figures.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION

Reference will now be made in detail to embodiments of the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Figure 1:
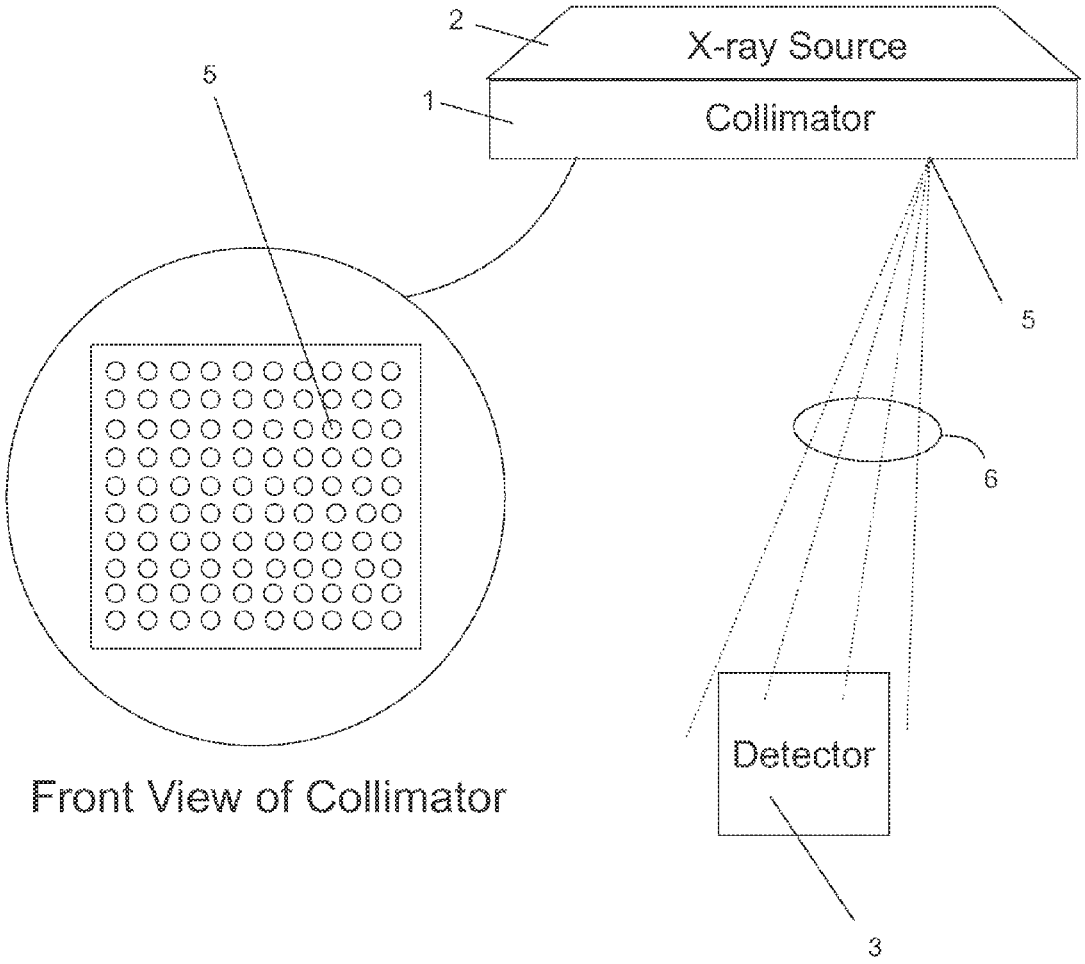
FIG. 1 is a diagram illustrating the elements of a multi focal spot x-ray beam system utilizing a collimator of one embodiment of the present invention.

FIG. 1 is a diagram illustrating the elements of a multi focal spot x-ray beam system utilizing a collimator of one embodiment of the present invention. A focal spot is an area on a face of an x-ray source from which x-rays may be emitted. Hence, a multi focal spot system may entail an x-ray source configured to emit x-rays through one or more number of points, in contrast to a single focal spot system where the x-ray source may only emit x-rays from a single contiguous area. A multi focal spot x-ray source may be an emissive target screen such as a tungsten sheet on which a high energy electron beam is directed to excite the various points. As shown in FIG. 1, collimator 1 may be attached, or placed very near, the end of x-ray source 2 through which x-rays are emitted. Collimator 1 may have a pattern of holes, or apertures, such that when a given focal spot is illuminated by source 2, corresponding individual aperture 5 projects a beam of x-rays 6 toward detector 3. The details of one multi focal spot x-ray system are described in U.S. Pat. No. 5,835,561 issued to Moorman et al. entitled "Scanning beam x-ray imaging system," herein fully incorporated by reference.

The image quality of x-ray images can increase with the number of x-rays incident on the detector face. This may be particularly true in "inverse geometry" systems, such as a scanning beam system, where the detector is significantly smaller than conventional systems and therefore intercepts very few quality-degrading scattered x-ray beams. However, simply increasing the number of x-rays emitted by the source may not be beneficial since beams which are not fully absorbed within the detector not only increase the dose to the patient without image quality benefits but also may be absorbed by attending personnel. A large amount of x-ray exposure, either in a few large doses or many smaller doses over time, has been shown to have potentially negative health effects such as an increased risk for the development of cancer.

Figure 2:
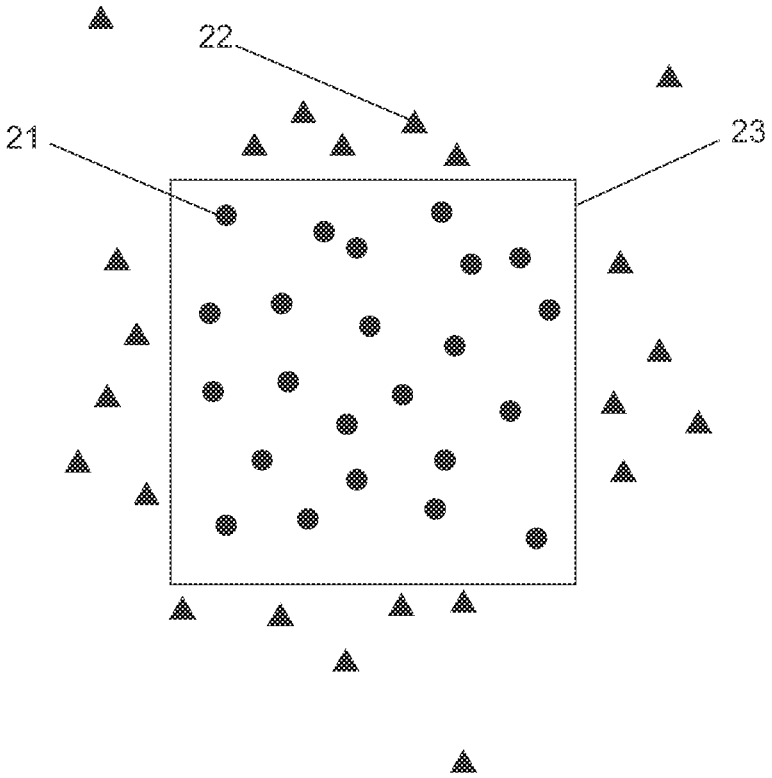
FIG. 2 is a diagram illustrating the spill of x-ray radiation around a detector face.

In order to maintain high image quality while minimizing potentially harmful x-ray exposure to the patient and medical personnel in the vicinity of an x-ray imaging system, it may be desireable that the cross section of beam 6 in the plane of the detector face entail as much area inside and as little area outside of the detector face as possible. X-rays that either escape or pass through the collimator but do not intersect the detector face are referred to as spill. FIG. 2 is a diagram in which the circular points 21 represent points of intersection between x-rays in beam 6 and the detector face 23 of detector 3, and the triangular points 22 represent points of intersection between x-rays in beam 6 with area outside of the detector face 23, i.e. spill.

In multi focal spot collimators, an additional problem can arise as leakage. Leakage is the passage of x-rays through some volume of collimator outside of an intended aperture. In a collimator designed for a single focal spot source, leakage is essentially a form of spill and can be easily reduced if not eliminated by increasing the dimensions of the collimator to the point where an x-ray travelling outside of the aperture has little to no chance of penetration. However, reaching similarly sufficient dimensions in multi focal spot collimators becomes unwieldy, especially in cases where the pitch, the distance between adjacent focal spots, is very small.

Figure 3:
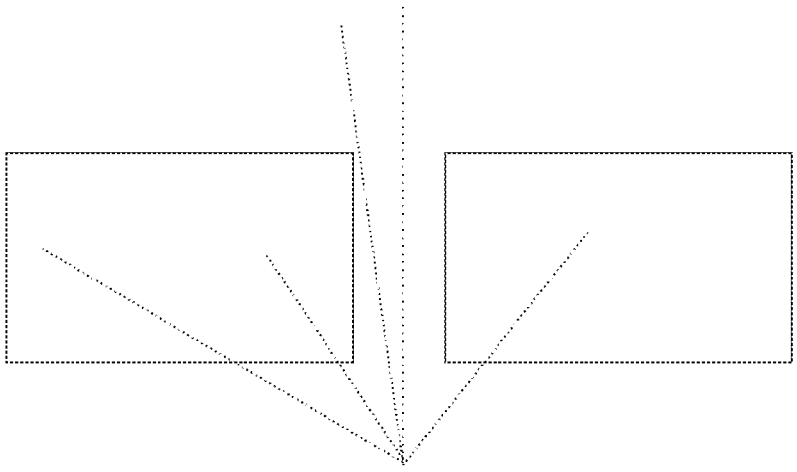
FIG. 3 is a diagram illustrating paths of errant x-rays through single focal spot collimator.
Figure 4:
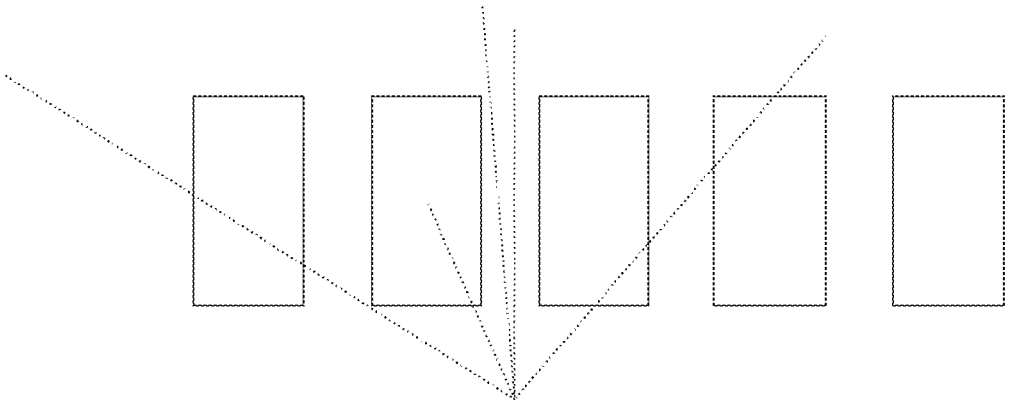
FIG. 4 is a diagram illustrating paths of errant x-rays through a multi focal spot collimator of length along the source-detector axis equal to that in FIG. 3.

FIG. 3 is a diagram of the paths of errant x-rays through a single focal spot collimator, and FIG. 4 is a diagram of the paths of errant x-rays through a multi focal spot collimator of equal length along the source-detector axis. In FIG. 3, x-rays from a single focal spot source that do not pass through the entrance to the collimator aperture or are angled very steeply relative to a forward direction of travel must follow paths through a significant depth of collimator material to escape and therefore have a high probability of being scattered or absorbed within the collimator. In FIG. 4, x-rays from a single focal spot which fall outside of a corresponding aperture entrance or are steeply angled may escape by following paths requiring travel through only short depths of collimator material, over which there is a low probability of scatter or absorption.

An advantage of embodiments of the present invention is the flexibility to address spill control and leakage control separately through independent subassemblies. Separating these functions allows the designer to more easily select or optimize material, aperture shape, and fabrication method for each function.

X-ray interaction with materials is in large part determined by the atomic number of the materials. Atomic number, the characteristic number of protons in the nuclei of elemental atoms (and also the number of surrounding electrons if the atoms are stable and charge-neutral), determines the density of charged particles in a material. The probability that an x-ray will interact with a charged particle and lose some of its energy increases with the density of charged particles so materials with a high atomic number are more likely to attenuate x-ray radiation. These materials tend to be more costly and weigh significantly more than materials with a lower atomic number so the ability to choose a material with an atomic number appropriate to a specific attenuation strength may have weight and cost benefits.

High Z materials are materials with high atomic numbers e.g. an atomic number of at least thirty-nine, and lower Z materials are materials with low atomic numbers e.g. an atomic number greater than ten and less than thirty-nine.

In an embodiment of the present invention, a subassembly with the function of leakage control may be constructed from a high Z material such that it will attenuate errant x-rays within a distance similar to the pitch e.g. a material with an atomic number of at least 39 or alternatively 40, 41, 42, 46, 47, 48, 49, 50, 51, 52, 55, 56, 73, 74, 77, 78, 79, 80, 82 or 83 or any range of atomic numbers between 39 and 83. For example, lead is one high Z material that would suffice for leakage control. The subassembly may be composed of a number of 0.5 mm thick plates or alternatively 1, 2, 3, 4, 5, 6, 7, 8, 9, 10, 11, 12, 13, 14 or 15 mm or any thickness between 0.5 and 15 mm or any range of thickness between 0.5 and 15 mm. Two to thirty plates may be layered to comprise the subassembly or a single plate can be used or any range of number of plates between one and thirty plates.

The shape and size of apertures through the leakage control subassembly may be a system-specific design consideration. The apertures may be holes of standard shapes such as circles or squares or have less regular edge geometries. In one embodiment of the present invention, the apertures are round or can be a constant width or radius through the thickness of the leakage subassembly in order to consistently reduce the passage of x-rays between adjacent apertures. The method of creating apertures through the leakage control subassembly may be chemical etching, an electrical discharge machining method, or standard drilling or milling. In an embodiment of the present invention in which the leakage control subassembly is comprised of lead sheets, apertures can be created using chemical etching.

Spill may be reduced by incorporation of a functional subassembly with the specific purpose of spill control. This spill control subassembly may be constructed out of a lower Z material since it can attenuate x-rays over the length of the collimator, which may be long compared to the pitch e.g. a material with an atomic number greater than ten and less than thirty-nine or alternatively 11, 12, 13, 14, 15, 16, 17, 19, 20, 22, 24, 25, 26, 27, 28, 29, 30, 31, 32, 33, 34, 35 or 38 or any range of atomic numbers between 11 and 38. Steel and brass are two examples of lower Z materials that would be sufficient for spill control. The spill control subassembly may also be composed of 0.5 mm plates or alternatively 1, 2, 5, 7, 10, 15, 20, 25, 30, 35, 40, 45, 50 or 55 mm or any thickness between 0.5 and 55 mm or any range of thickness between 0.5 and 55 mm. The number of plates may range between ten and 110 or a single plate can be used or any range of number of plates between 10 and 110.

The shape and size of apertures through the spill control subassembly may be a system-specific design consideration. The apertures may be holes of standard shapes such as circles or squares or have less regular edge geometries. In one embodiment of the present invention, the width or radii of apertures linearly increase through the thickness of the subassembly from a smallest width or radius at the aperture entrance to a largest width or radius at the aperture exit. The method of creating apertures through the spill control subassembly may be chemical etching, an electrical discharge machining method, or standard drilling or milling. When the spill control subassembly is made of brass or steel, apertures may be created using chemical etching.

Figure 5:
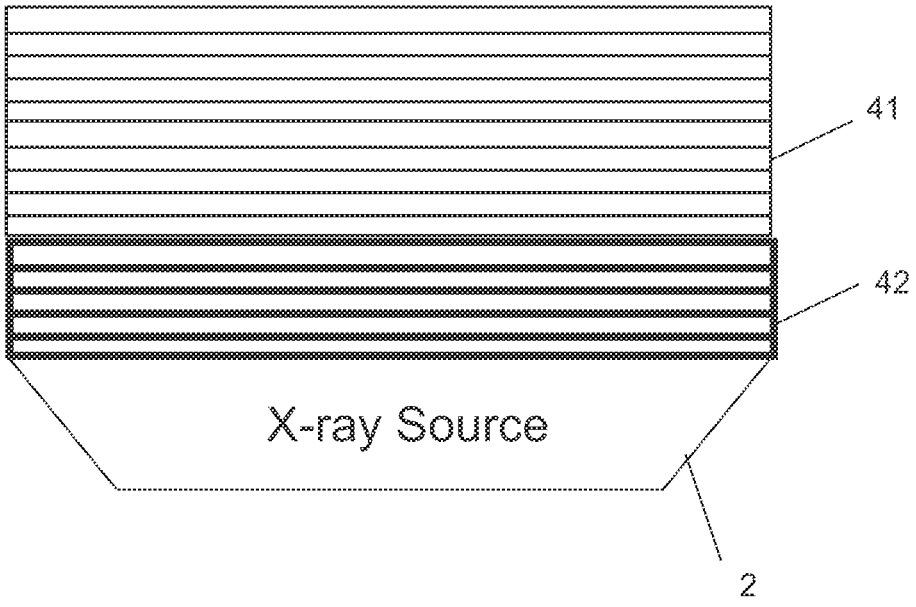
FIG. 5 is a diagram illustrating an embodiment of the present invention, a collimator comprising just two functional subassemblies, a spill control subassembly and a leakage control subassembly.

FIG. 5 illustrates an embodiment of the present invention, a collimator comprising just two functional subassemblies, a spill control subassembly 41 and a leakage control subassembly 42. It can be seen that spill control subassembly 41 is constructed from ten plates of a lower Z material such as brass, and the leakage control subassembly 42 is constructed from five plates of high Z material such as lead. The lower Z material can have an atomic number greater than ten and less than thirty-nine or alternatively 11, 12, 13, 14, 15, 16, 17, 19, 20, 22, 24, 25, 26, 27, 28, 29, 30, 31, 32, 33, 34, 35 or 38 or any range of atomic numbers between 11 and 38. The high Z material can have an atomic number of at least 39 or alternatively 40, 41, 42, 46, 47, 48, 49, 50, 51, 52, 55, 56, 73, 74, 77, 78, 79, 80, 82 or 83 or any range of atomic numbers between 39 and 83.

Additional problems intrinsic to multi focal point collimation may be addressed by constructing the two plates of the FIG. 5 embodiment out of specific materials and/or adding further subassemblies.

Transmissive x-ray sources may be comprised of a beam of high energy electrons directed at an emissive target screen. If the path of the electron beam is controlled by an applied magnetic field, it may be necessary to magnetically shield the x-ray source to prevent external magnetic forces from redirecting the beam.

Magnetic permeability is a measure of the tendency of a material to become magnetized and can be quantified in units such as henries per meter. Relative magnetic permeability simply refers to a magnetic permeability value which has been divided by the magnetic permeability of free space and is thus unit-less. If a magnetically permeable material is placed in an external magnetic field, it becomes magnetized and draws the force of that magnetic field to itself. Therefore, a volume of magnetically permeable material can terminate a magnetic field before it reaches some unwanted location. This is one method of magnetic shielding.

While intrinsically permeable materials may be used for magnetic shielding, the magnetic properties of some other materials may be altered by heat and other treatment methods and can also become suitable for magnetic shielding purposes. A material is considered magnetically permeable rather than transparent if its relative permeability is greater than one, but as materials can be found with very high permeability values, a material with a relative permeability greater than 10,000 may be chosen for magnetic shielding applications. It is also desirable that the material be magnetically "soft," i.e. quick to release magnetization once a field is removed, so that the shield responds quickly to changes in magnetic environment.

Magnetic shielding may be incorporated as a function in an embodiment of the present invention by adding a further subassembly made of magnetically permeable material or other magnetic shielding material or by fabrication of the aforementioned spill reduction plates out of a lower Z material that is magnetically permeable or otherwise suited for magnetic shielding. Mu-metals, a class of nickel-iron alloys with relative magnetic permeability values between 80,000 and 100,000, comprise one class of materials from which either of these subassemblies may be fabricated. Nickel has an atomic number of twenty-eight and iron an atomic number of twenty-nine.

Possible additions to mu-metal alloys are molybdenum and copper, which have atomic numbers of twenty-six and forty-two respectively. Other materials can be used with relative magnetic permeability of at least 100 or values between 100 and 1,000,000 or any range of relative magnetic permeability between 100 and 1,000,000.

If a separate magnetic shielding subassembly is incorporated into the collimator, the shape and size of apertures through it may be a system-specific design consideration. The apertures may be holes of standard or non-standard shapes with radii or width as large or larger than the desired x-ray beam radius in the plane of the subassembly and small enough that the subassembly mimics the shielding properties of a continuous sheet. The method of creating these apertures may be chemical etching, an electrical discharge machining method, or standard drilling or milling.

If the function of magnetic shielding is incorporated into the spill control subassembly in the collimator, the shape and size of apertures may be determined by the previously discussed beam-shaping considerations and machined using chemical etching, an electrical discharge machining method, or standard drilling or milling. In an embodiment of the present invention in which a subassembly with the function of spill control and magnetic shielding is made from mu-metal, the apertures through the subassembly may be created via chemical etching.

X-ray imaging systems such as "Scanning beam x-ray imaging system" and others which utilize transmissive x-ray sources such as the one described in U.S. Pat. No. 5,682,412 entitled "X-ray Source," and herein incorporated by reference, can require stabilization against the pressure applied by a fluid-based coolant system because the collimator will be in contact not only with the emissive target screen but also a coolant fluid system. The collimator must be able to withstand the pressure from adjacent fast-flowing coolant or be otherwise stabilized. Without some sort of stabilization, elements in contact with the flowing coolant can bow.

The tendency of a material to bow decreases as its stiffness increases. The stiffness of a material relates to the amount of strain, the amount of deformation relative to its original dimensions, exhibited by the material when an external stress is applied and is characterized by a quantity called Young's modulus.

Stabilization may be incorporated by the addition of a further subassembly made of a sufficiently stiff material or by constructing the leakage control subassembly from a sufficiently stiff, high Z material e.g. a material with an atomic number of at least 39 or alternatively 40, 41, 42, 46, 47, 48, 49, 50, 51, 52, 55, 56, 73, 74, 77, 78, 79, 80, 82 or 83 or any range of atomic numbers between 39 and 83. The value of Young's modulus required to sufficiently stabilize a system may depend on the thickness of the subassembly as well as the properties of the coolant fluid system, and may be at least 200 GPa. Alternatively, a material with Young's modulus of 150, 150-185, 159, 181, 193, 200, 190-210, 207, 248, 276, 287, 329, 345, 400-410, 435, 450, 450-650, 517, 550, 1000, 1050-1200, 1220 GPa or values between 150 and 1220 GPa or any range between 150 and 1220 GPa can be used. Carbon fiber, diamond, silicon carbide, steel, tungsten, tungsten carbide, iron, silicon, beryllium, molybdenum, sapphire, osmium, graphene, chromium, iridium, or tantalum can be used. A subassembly for stabilization (and leakage control) may be constructed as a solid layer of thickness greater than 2 mm and less than 1.2 cm or any range of thickness between 2 mm and 1.2 cm.

If a separate stabilization subassembly is incorporated into the collimator, the subassembly may be made from stainless steel. The shape and size of apertures through a separate stabilization subassembly may be a system-specific design consideration. The apertures may be holes of standard shapes with radii or width as large or larger than the desired x-ray beam radius and small enough that the subassembly maintains a degree of stiffness sufficient to prevent bowing under pressure from a cooling fluid. The method of creating these apertures may be chemical etching, an electrical discharge machining method, or standard drilling or milling.

If the function of stabilization is incorporated into the leakage control subassembly in the collimator, the subassembly may be made from tungsten. Tungsten has an approximate Young's modulus between 400 GPa and 410 GPa and an atomic number of 74. The shape and size of apertures through a stabilizing leakage control subassembly may be determined by the previously discussed x-ray leakage considerations and machined using chemical etching, an electrical discharge machining method, or standard drilling or milling. In an embodiment of the present invention in which a subassembly with the function of leakage control and stabilization is made from tungsten, the apertures through the subassembly are created using an electrical discharge machining drill.

In another embodiment of the present invention, a subassembly is added to the face of the collimator nearest the source with the function of providing preliminary x-ray focusing such as the attenuation of x-rays emerging from the source completely unaligned with any particular aperture. The subassembly may be a layer of high Z material e.g. a material with an atomic number of at least 39 or alternatively 40, 41, 42, 46, 47, 48, 49, 50, 51, 52, 55, 56, 73, 74, 77, 78, 79, 80, 82 or any range of atomic numbers between 39 and 83. Its thickness can be greater than 0.5 mm or alternatively 1, 2, 3, 4, 5, 6, 7, 8, 9, 10, 11, 12, 13, 14 or 15 mm or any thickness between 0.5 and 15 mm or any range of thickness between 0.5 and 15 mm. For ease of reference, this subassembly will be referred to as an entrance plate in further descriptions.

The shape and size of apertures through the entrance plate may be a system-specific design consideration. The apertures may be holes of standard shapes such as circles or squares or have less regular edge geometries. The radii or width of the apertures may be larger than the radii or width of apertures in subsequent collimator subassemblies. The method of creating apertures through the entrance plate may be chemical etching, an electrical discharge machining method, or standard drilling or milling. In embodiments of the present invention in which the entrance plate is made of lead, apertures may be created using chemical etching.

In another embodiment of the present invention, a subassembly is added to the face of the collimator farthest from the source with the function of providing a shield against x-rays which, after passing through the rest of the collimator, maintain a path of travel that would not strike the detector face if uninterrupted. This subassembly may be comprised of a layer of high Z material e.g. a material with an atomic number of at least 39 or alternatively 40, 41, 42, 46, 47, 48, 49, 50, 51, 52, 55, 56, 73, 74, 77, 78, 79, 80, 82 or 83 or any range of atomic numbers between 39 and 83. Alternatively, this subassembly may be composed of a lower Z materials, e.g. a material with an atomic number greater than ten and less than thirty-nine or alternatively 11, 12, 13, 14, 15, 16, 17, 19, 20, 22, 24, 25, 26, 27, 28, 29, 30, 31, 32, 33, 34, 35 or 38 or any range of atomic numbers between 11 and 38. Its thickness can be greater than 1 mm or alternatively 1, 2, 3, 4, 5, 6, 7, 8, 9, 10, 11, 12, 13, 14 or 15 mm or any thickness between 1 and 15 mm or any range of thickness between 1 and 15 mm. For ease of reference, this final layer of spill reduction will be referred to as an exit plate in further descriptions.

The shape and size of apertures through the exit plate may be a system-specific design consideration. The apertures may be holes of standard shapes such as circles or squares or have less regular edge geometries. In one embodiment of the present invention, the radii or width of apertures linearly increase through the thickness of the subassembly from a smallest radius or width at the aperture entrance to a largest radius or width at the aperture exit. The radius or width at the aperture entrance may be as large or larger than the aperture exit of the spill control subassembly or other subassembly positioned adjacent to the exit plate. The method of creating apertures through the exit plate may be chemical etching, an electrical discharge machining method, or standard drilling or milling. In embodiments of the present invention in which the exit plate is comprised of lead, apertures may be created using chemical etching.

An embodiment of the present invention may be suitable for use in a system with a rectangular x-ray detector, where one dimension of the detector face is longer than other dimension of the face and longer that the dimension of square detector faces used in conventional scanning beam systems. In this embodiment, the apertures through the exit plate may be rectangular, where the long dimensions of the apertures corresponds to the long dimension of the detector.

The length of the long dimension of the apertures required for rectangular beam collimation may increase with increases in detector length or with decreases in the distance from the source face to the detector face. For some geometries, the required aperture width may be as wide or wider than the pitch so that apertures within a long-dimension row "overlap," forming a slot rather than a series of holes. Therefore, in a further embodiment of the present invention suitable for use with a rectangular detector, apertures through the exit plate may be comprised of slots. In this embodiment, the exit plate may control spill only along the short dimension of the detector as significant material along the long dimension has been removed. It may therefore be desirable to increase the amount of spill control along the long dimension in planes closer to the source by adding additional spill control subassemblies or using more highly attenuating materials for near-source spill control subassemblies.

Figure 6:
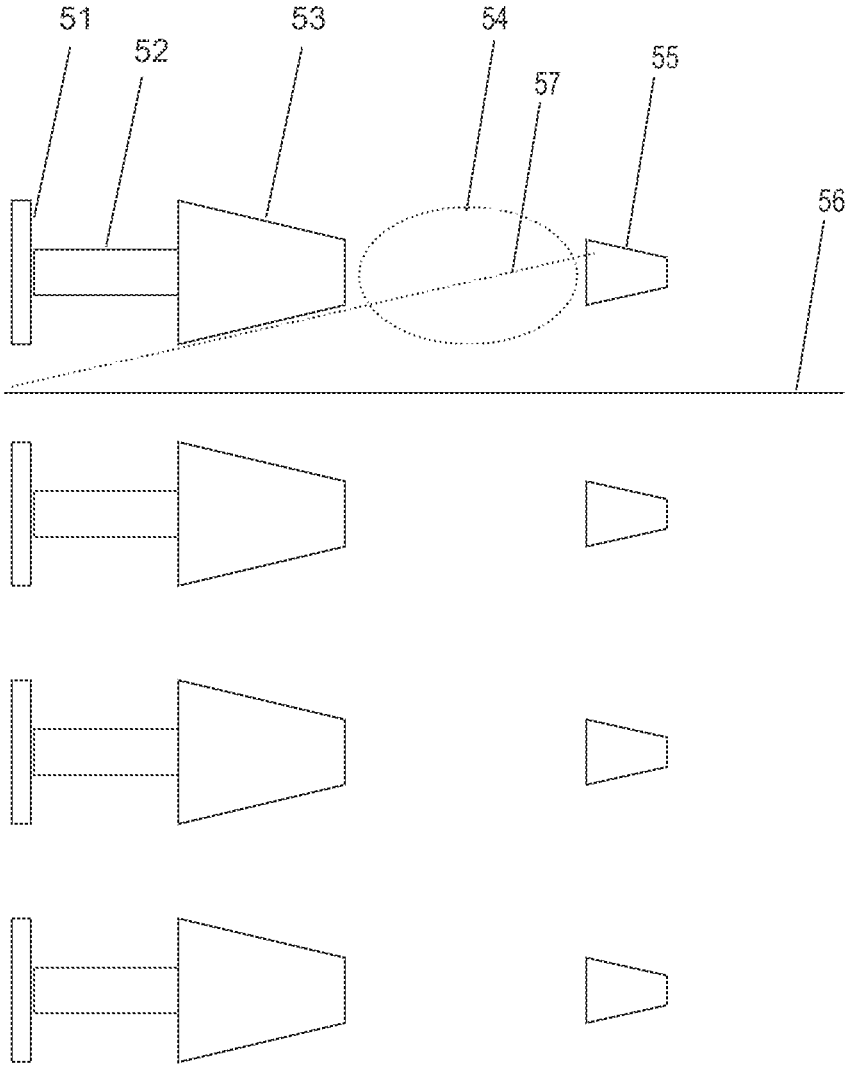
FIG. 6 is a diagram illustrating a side-view vertical cross-section of an approximate configuration of one embodiment of the present invention which combines four functional subassemblies.

FIG. 6 illustrates a side-view vertical cross-section of an approximate configuration of one embodiment of the present invention which combines four of the functional subassemblies described above. Beginning from the side of the collimator nearest the x-ray source, the configuration is comprised of entrance plate 51 comprised of two 0.5 mm lead sheets with aperture pattern of squares fabricated by chemical etching; stabilization and leakage control plate 52 comprised of a 6.5 mm layer of tungsten with aperture pattern of squares fabricated with an electrical discharge machining drill; magnetically shielding spill control plates 53 comprised of twenty-one intermixed mu-metal and lead sheets with aperture pattern of squares fabricated using chemical etching; an air gap 54 of 1.5 cm in length; and an exit plate 55 comprised of twenty 0.5 mm brass sheets with aperture pattern of squares fabricated using chemical etching.

The air gap 54 is another feature which may be incorporated. The placement of air gaps between adjacent subassemblies can increase material efficiency and reduce collimator weight while maintaining or increasing collimation performance. FIG. 6 also depicts an x-ray 57 angled relative to an axis 56 through the center of an aperture such that if its path were any more obtuse it would intersect the magnetically shielding spill control plates 53. Few to no x-rays would be absorbed by material inserted in the space of the air gap which isn't already absorbed by the exit plate. However, if the air gap were removed by exit plate 55 being placed in direct contact with magnetically shielding spill control plates 53, x-ray 57 would not be attenuated before leaving the collimator and may become spill. Placement of air gap 54 incurs little to no additional fabrication cost and adds no material weight but enhances spill reduction. Air gap dimension can be 0.5 mm or alternatively 1, 2, 5, 7, 10, 15, 20, 25, 30, 35, 40, 45, 50, 55, 60, 65 or 70 mm or any value between 0.5 and 70 mm or any range of values between 0.5 and 70 mm. Alternatively, air gap dimension can be 1, 2, 5, 7, 10, 15, 20, 25, 30, 35, 40, 45, 50, 55, 60, 65 or 70 percent of the thickness of the collimator or any percentage between 1 and 70 percent or any range of percentages between 1 and 70 percent.

Air gaps may be inserted between any two functional subassemblies, between two sheets within subassemblies composed of a plurality of sheets, or within an otherwise solid layer subassembly, and may incur benefits such as those described above.

Figure 7:
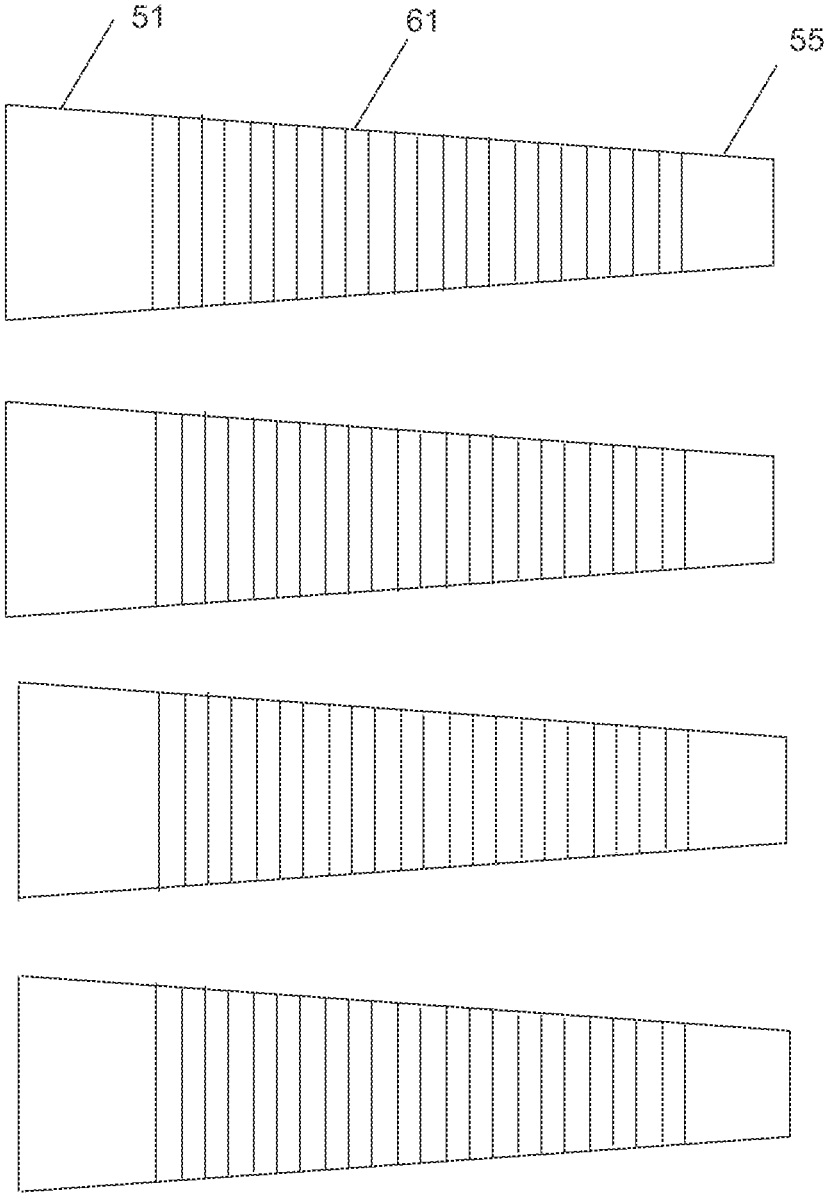
FIG. 7 is a diagram illustrating an embodiment of the present invention in which two sheeted subassemblies have been interleaved.

FIG. 7 is a diagram illustrating an embodiment of the present invention comprising entrance plate 51 and exit plate 55 positioned on either end of a section of intermixed mu-metal sheets and lead sheets 61. Subassemblies comprised of a plurality of sheets may be interleaved with one another. In FIG. 7, this technique has been applied to a mu-metal magnetically shielding spill control subassembly and a lead leakage control subassembly such that these two subassemblies together form section 61.

Figure 8:
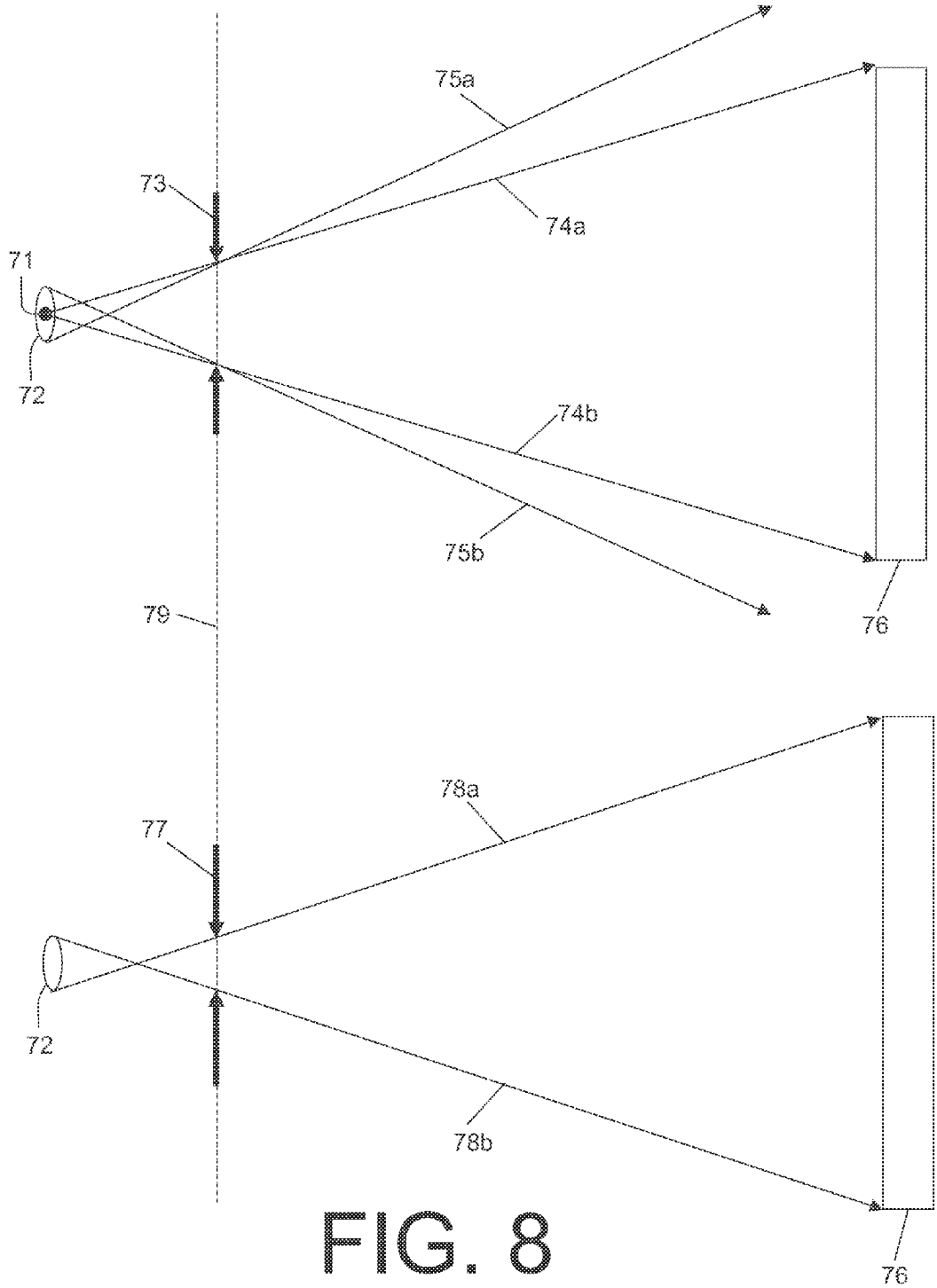
FIG. 8 is a diagram illustrating the effect that focal spot blurring may have on the size of the desired x-ray beam radius in the plane of a subassembly.

An aperture design consideration which may pertain to embodiments of the present invention will now be briefly discussed. Reference has been made to the radii or width of apertures being made "as large or larger than the desired x-ray beam radius in the plane of the subassembly." FIG. 8 is a diagram illustrating the effect that focal spot blurring may have on the size of the desired x-ray beam radius in the plane of a subassembly. "Focal spot blurring" refers to the fact that focal spots in a scanning beam source may have some finite radius rather than existing as a single point on the transmissive target screen. Focal spot blurring may be necessary to avoid destroying the target screen by concentrating too much energy, and hence too much heat, in too small of an area.

In the upper image of FIG. 8, beam width 73 in plane 79 is determined by x-ray 74*a* and x-ray 74*b*, which lie along the outer edge of a beam emanating from point focal spot 71 and covering the face of detector 76. However, if an x-ray beam emanating from blurred focal spot 72 is shaped to beam width 73 in plane 79, it will cover an area including the face of detector 76 and some area around it. It can be seen that x-rays 75*a* and 75*b*, which lie along the outer edge of such a beam, will become spill. Therefore, in the lower image of FIG. 8, corrected beam width 77 is drawn in plane 79. Corrected beam width 77 is determined x-rays 78*a* and 78*b*, which lie along the outer edge of a beam emanating from blurred focal spot 72 and covering the face of detector 76. It can be seen that corrected beam width 77 is smaller than beam width 73.

For embodiments of the present invention, the determination of the desired x-ray beam radius in the plane of the subassembly may take into account the effects of focal spot blurring. To obtain a desired beam radius for the subassembly plane, one may calculate a width using a point focal spot model, e.g. calculate beam width 73, and then decrease this width by ten percent. The radius may also be approximated by decreasing the width from a point focal spot model by some other percent in light of prior source behavior or known focal spot size. The percentage decrease can be 5, 6, 7, 8, 9, 10, 11, 12, 13, 14, 15, 16, 17, 18, 19, or 20 percent or any range of percentages between 5 and 20 percent. Apertures may then be sized accordingly.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An x-ray collimator comprising:

a first subassembly with a first plurality of adjacent apertures with each of said adjacent apertures corresponding to a single selected x-ray focal spot of a plurality of x-ray focal spots reducing leakage of x-ray radiation through apertures other than said aperture corresponding to said single selected x-ray focal spot; and a second subassembly positioned between said first subassembly and an imaging object reducing amount of said x-ray radiation striking outside an x-ray detector, said second subassembly with a second plurality of apertures corresponding to said first plurality of apertures and said plurality of x-ray focal spots wherein entrances of said second plurality of apertures is smaller than exits of said second plurality of apertures and wherein size of said second plurality of apertures linearly increase through thickness of said second subassembly from smallest at said entrances of said second plurality of apertures to largest at said exits of said second plurality of apertures.

2. The x-ray collimator of claim 1 wherein said first subassembly is made from a material with an atomic number of at least 39.

3. The x-ray collimator of claim 1 wherein said first subassembly is made from a material with a value of Young's modulus of at least 200 GPa.

4. The x-ray collimator of claim 1 wherein said first subassembly is made from tungsten.

5. The x-ray collimator of claim 1 wherein said first subassembly is made from lead.

6. The x-ray collimator of claim 1 wherein said first subassembly further comprises material sheets with thickness of at least 0.5 millimeters.

7. The x-ray collimator of claim 1 wherein thickness of said first subassembly is at least 1 millimeter.

8. The x-ray collimator of claim 1 wherein said second subassembly further comprises material sheets with thickness of at least 0.5 millimeters.

9. The x-ray collimator of claim 8 wherein said second subassembly further comprises an air gap of at least 0.5 millimeters between said material sheets.

10. The x-ray collimator of claim 1 wherein said second subassembly is made from a material with an atomic number greater than 10 and less than 39.

11. The x-ray collimator of claim 1 wherein said second subassembly is made from a material with relative magnetic permeability of at least 10,000.

12. The x-ray collimator of claim 1 wherein said second subassembly is made from mu-metal.

13. The x-ray collimator of claim 1 wherein said second subassembly is made from brass.

14. The x-ray collimator of claim 1 wherein said second subassembly is made from steel.

15. The x-ray collimator of claim 1 wherein thickness of said second subassembly is at least 5 millimeters.

16. The x-ray collimator of claim 1 further comprising:

a third subassembly positioned between said first subassembly and an x-ray source, said third subassembly with a third plurality of apertures and a thickness of at least 0.5 millimeters and made from a material with an element having an atomic number of at least 39.

17. The x-ray collimator of claim 1 further comprising:

a fourth subassembly positioned between said second subassembly and said x-ray detector, said fourth subassembly with a fourth plurality of apertures and a thickness of at least 1 millimeter and made from a material with an element having an atomic number of at least 39.

18. The x-ray collimator of claim 17 wherein said fourth subassembly is separated from said second subassembly by an air gap of at least 0.5 millimeters.

19. A x-ray collimator of claim 17 wherein entrances of said fourth plurality of apertures is smaller than exits of said fourth plurality of apertures.

20. The x-ray collimator of claim 1 further comprising:

a fourth subassembly positioned between said second subassembly and said x-ray detector, said fourth subassembly with a fourth plurality of apertures and a thickness of at least 1 millimeter and made from a material with an element having an atomic number greater than 10 and less than 39.

* * * * *